United States Patent [19]

Hennuy et al.

[11] Patent Number: 4,837,952

[45] Date of Patent: Jun. 13, 1989

[54] STEAM IRON HAVING VARIABLE HEAT CONDUCTIVITY BETWEEN THE HEATING BASE AND SOLE PLATE

[75] Inventors: Jean Hennuy, Villefranche/Saone; Bernard Louison, Stetienne, both of France

[73] Assignee: SEB S.A., Selongey, France

[21] Appl. No.: 111,158

[22] Filed: Oct. 22, 1987

[30] Foreign Application Priority Data

Oct. 31, 1986 [FR] France ..... 86 15196

[51] Int. Cl.[4] ..... D06F 75/24; D06F 75/38

[52] U.S. Cl. ..... 38/77.7; 38/77.83

[58] Field of Search ..... 38/77.7, 77.8, 77.81, 38/77.82, 77.83, 84, 85, 88

[56] References Cited

U.S. PATENT DOCUMENTS

| | | | |
|---|---|---|---|
| 1,963,858 | 6/1934 | Meidell . | |
| 2,078,061 | 4/1937 | Cooper | 38/77.82 |
| 2,160,421 | 5/1939 | Sebo . | |
| 2,161,009 | 6/1939 | Brave . | |
| 2,411,199 | 11/1946 | Felver . | |
| 2,846,794 | 8/1958 | Pavlic . | |
| 2,871,589 | 2/1959 | Schwaneke | 38/77.7 |
| 2,880,530 | 4/1959 | Schwaneke . | |
| 3,263,350 | 8/1966 | Abraham . | |
| 4,107,860 | 8/1978 | Coggiola | 38/77.83 |

FOREIGN PATENT DOCUMENTS

| | | |
|---|---|---|
| 1160399 | 1/1964 | Fed. Rep. of Germany . |
| 2279879 | 2/1976 | France . |
| 2566439 | 12/1985 | France . |
| 1026882 | 4/1966 | United Kingdom . |

*Primary Examiner*—Andrew M. Falik

*Attorney, Agent, or Firm*—Young & Thompson

[57] ABSTRACT

Steam generated within a vaporization chamber (4) by water droplets (16) as they fall onto a base (1) in which is embedded a heating resistor (17) is directed onto fabrics to be ironed through sole-plate orifices (26). When the base temperature is high, a closure member (32) attached to a bimetallic strip (33) is opened, steam flows through an intercalary space (23) between the base and the sole-plate, then escapes through a peripheral gap (25), thus completing heat transfers from base to sole-plate by convection and conduction. In the case of low temperatures, the closure member is placed in the closed position, air is admitted into the intercalary space (23) and forms a shield between sole-plate and base. The base temperature is than sufficient for generation of steam while the sole-plate is at a relatively low temperature which permits ironing of delicate fabrics.

32 Claims, 3 Drawing Sheets

STEAM IRON HAVING VARIABLE HEAT CONDUCTIVITY BETWEEN THE HEATING BASE AND SOLE PLATE

BACKGROUND OF THE INVENTION

1. Field of the Invention

The present invention relates to a steam iron.

2. Description of the Prior Art

In conventional steam irons, steam is produced by bringing water into contact with the top face of a heating base, the bottom face of which constitutes the ironing sole-plate or else it is covered by a separately mounted ironing sole-plate.

When ironing delicate fabrics, however, the temperature of the heating base must be limited to a value such that the quantities of water which can thus be vaporized are not sufficient to achieve significantly greater ease of ironing.

In one known type of iron disclosed in French patent No. FR-A-2,279,879, a space is provided between the heating base and the sole-plate for the distribution of steam to discharge orifices formed through the sole-plate.

This arrangement permits distribution of steam to the discharge orifices without having recourse to additional parts separately attached to the base. In the cited patent, it is sought to achieve the highest possible degree of thermal conduction between the base and the sole-plate. It may thus be expected that the temperature of the sole-plate is very close in value to that of the base by conduction of the bosses on which said base is supported on the sole-plate, by conduction of the steam which is present between base and sole-plate, by convection circulation of steam, and by radiation. Thus, in the case of delicate fabrics to be ironed, the temperature of the heating base must once again be reduced to a value which permits only a very low rate of steam delivery. Even if the attempt to achieve good conduction in accordance with the cited patent had failed to meet with success, there would still remain the major problem of high electric power consumption required for ironing at high temperature in order to bring the heating base to a suitable temperature while producing quantities of steam which become very substantial. In addition to this drawback, the components of the iron would be heated to high temperatures which would adversely affect their service life and even prove excessive with respect to certain standards.

Accordingly, the aim of this invention is to propose a laundry iron which is capable of producing a substantial rate of steam delivery in respect of relatively low ironing temperatures while at the same time ensuring that the power required for ironing at high temperatures as well as the resultant heat build-up within the iron are not liable to become prohibitive.

SUMMARY OF THE INVENTION

In accordance with the invention, the steam iron which includes a heating base, a sole-plate mounted beneath said heating base so as to provide an intercalary space containing a fluid between the heating base and the sole-plate, means for generating steam by bringing a supply of water into contact with a top face of the heating base, and means for regulating the ironing temperature, is essentially provided with means whereby the nature and/or state of the fluid which is present within the intercalary space can be modified as a function of the ironing temperature with a view to relatively enhancing heat transfers from the base to the sole-plate within a high range of ironing temperatures and with a view to relatively retarding the aforesaid heat transfers within a low range of ironing temperatures.

Thus, during a low-temperature ironing operation, the intercalary space constitutes a virtual thermal shield between the heating base and the sole-plate. In consequence, the heating base must have a relatively high temperature in order to maintain the sole-plate at the moderate temperature which is desired for ironing. Thus the water which is brought into contact with the top face of the heating base vaporizes in a relatively large quantity. The iron in accordance with the invention thus permits steam-ironing even of the most delicate fabrics.

When ironing at high temperature, the conditions within the intercalary space are modified in such a manner as to facilitate heat transfers from the heating base to the sole-plate. To this end, it is possible for example to replace the fluid which is present at low temperature by a fluid having higher heat conductivity or to set a hot fluid in motion within the intercalary space so as to carry out the additional heat transfers by convection. Thus the temperature difference between the heating base and the sole-plate is of small value and ironing at high temperature can be performed without any excessive power consumption and without overheating of the components of the iron.

DESCRIPTION OF THE PREFERRED EMBODIMENTS

Figure 1:
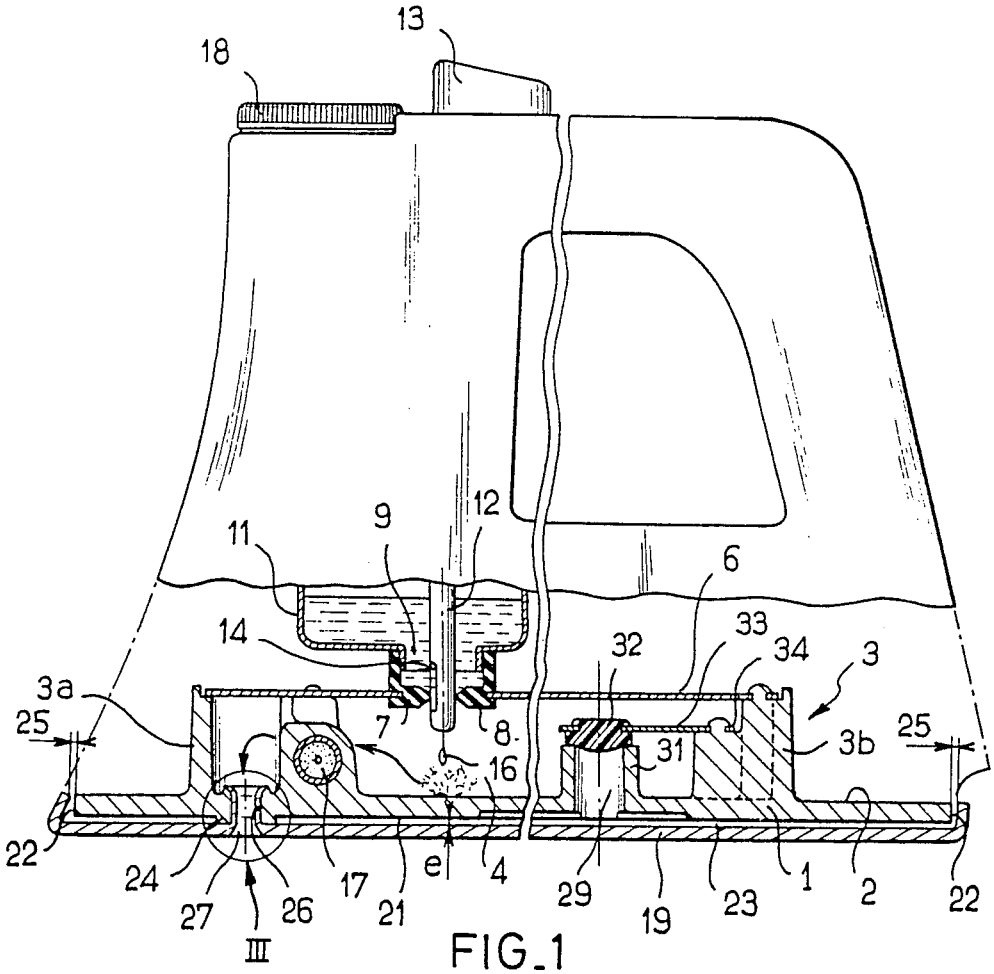
FIG. 1 is a schematic fragmentary longitudinal part-sectional view of a laundry iron in accordance with the invention as shown in the low-temperature ironing condition.
Figure 2:
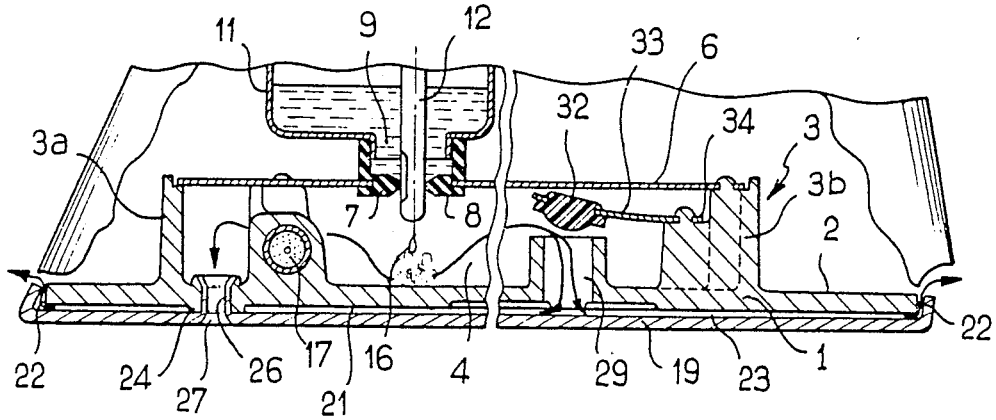
FIG. 2 is a view which is similar to the bottom portion of FIG. 1 in the high-temperature ironing condition.

In the example shown in FIGS. 1 and 2, the steam iron has a cast aluminum heating base 1 provided on its top face 2 with an annular rib 3, the front portion **3*a* and the rear portion 3*b* of which are visible in the figures. The base 1 and the rib 3 thus define together a vaporization chamber 4 which is closed at the top by means of a sheet-metal lid 6 having an opening 7, a nozzle 8 of plastic material being mounted within said opening in leak-tight manner. Said nozzle 8 is also tightly fitted on a bottom outlet 9 of a water reservoir 11 which is mounted above the vaporization chamber 4. A pintle 12 controlled by a push-button 13 which is clearly visible on the top face of the iron is provided with a longitudinal groove 14 formed in part of the length of its active end portion. Depending on whether it is surrounded or not surrounded by the lip of the nozzle 8, said longitudinal groove 14 respectively permits or prevents drop-by-drop flow of water from the reservoir 11 to the vaporization chamber 4. In the situation illustrated in the figures, the longitudinal position of the pintle 12 permits this flow of water and the droplets 16 come into contact with the top face of the heating base 1 on which they are vaporized as a function of the temperature to which the heating base 1 is heated by means of the electric resistor 17 embedded in the base at the time of casting. The power consumption of the resistor 17 is regulated by a thermostat, the sensitive element of which (not shown in the drawings) is in contact with the heating base 1. The temperature detected by the sensitive element is compared with a temperature which is indicated by means of a selector knob 18**.

Figure 3:
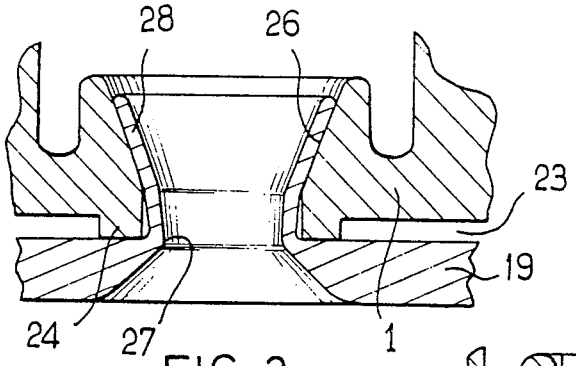
FIG. 3 is a view of the encircled detail III of FIG. 1, this diagram being drawn to a larger scale.

An ironing sole-plate 19 of die-stamped aluminum is attached to the heating base 1 so as to cover the bottom face 21 and the edge faces 22 of this latter. The sole-plate 19 is mounted on the base 1 in such a manner as to provide between these latter an intercalary space 23 which extends substantially over the entire bottom surface of the heating base. To this end, the heating base is provided on its bottom face with a series of annular bosses 24 (only one of which is illustrated in the figures), the height of which is equal to the thickness e desired for the intercalary space 23, that is, between 0.4 mm and 2 mm and preferably 0.6 mm. The annular bosses 24 each surround an orifice 26 which is formed through the base 1 within the annular rib 3. The sole-plate 19 is provided opposite to each orifice 26 with an orifice 27 surrounded by an annular lip 28 which is fitted within the orifice 26 of the base 1 (as shown in FIG. 3). During assembly, when the sole-plate 19 is positioned against the base 1, the lips 28 are substantially cylindrical. After completion of this assembly operation, the lips 28 of each orifice 27 are deformed conically so as to be applied against one wall of the orifices 26 which widens out in a conical flare away from the sole-plate 19. By means of the expanded joint thus formed, the sole-plate 19 is secured to the base 1 while being applied against the annular bosses 24. This mode of expansion-joint assembly is already known and described in French patent Application No. 86 01 019 in the name of the present Applicant.

Thus, the steam produced within the chamber 4 escapes through the orifices 27 of the sole-plate 19 and through the fabrics which are being ironed.

Provision is also made for an opening 29 which extends through the base 1 as shown in FIG. 1 and is located within the annular rib 3. On the side remote from the sole-plate 19, said opening 29 is surrounded by an annular boss 31, the free end of which forms a seating for a closure member 32, which is attached to a free end of a bimetallic strip 33 while the other end or anchoring end 34 of said bimetallic strip is fixed on a flange of the portion **3*b* of the annular rib 3**.

Within a low-temperature range of the heating base 1, the bimetallic strip 33 applies the closure member 32 against the annular boss 31, thus isolating the intercalary space 23 from the vaporization chamber 4 (as shown in FIG. 1).

When the temperature of the heating base 1 rises as a function of the position of the selector knob 18 until it attains a value within a high-temperature range, the bimetallic strip 33 bends in the upward direction and lifts the closure member 32 from the boss 31 (as shown in FIG. 2). The steam produced within the vaporization chamber 4 is thus permitted to follow an additional escape path through the opening 29, the intercalary space 23, and an annular space 25 provided between the peripheral edge face 22 of the base 1 and the upwardly directed peripheral flange of the sole-plate 19. This escape path is represented by arrows in FIG. 2.

The bimetallic strip 33 is of the snap-action type. In other words, the closure member 32 moves abruptly from the open position to the closed position and conversely when the temperature of the heating base 1 oversteps a predetermined temperature threshold in the direction respectively of a temperature drop and a temperature rise.

Consideration will now be given to the operation of the iron described in the foregoing.

When the temperature of the heating base is below a selected threshold value which may be equal to approximately 200° C., for example (with the closure member 32 in the closed position as shown in FIG. 1), the intercalary space 23 is in communication with the exterior and therefore contains air. The sole-plate 19 is heated by thermal conduction of the bosses 24 and of the expansion-joint lips 28, by conduction of the air which is present within the space 23 and by radiation emitted by the base 1 in the direction of the sole-plate 19. Under these conditions, the temperature of the sole-plate can be lower than the temperature of the heating base by approximately 40° C. Thus, even if the sole-plate is at the mean temperature of 110° C. which corresponds to ironing of the most delicate fabrics, the heating base 1 is maintained by the thermostat at a temperature of the order of 150° C. which permits an appreciable production of steam within the vaporization chamber 4. Within the low-temperature range, the temperature of the base is between 150° and 200° C. while the temperature of the sole-plate is between 110° and 160° C.

When the thermostat is so adjusted as to maintain the base at a temperature within the range of 200° to 260° C. (with the closure member 32 in the open position shown in FIG. 2), the steam produced within the chamber 4 replaces the stagnant air within the intercalary space 23, circulates within said space and escapes between the edges of the base and the sole-plate. This reduces the temperature difference between the base and the sole-plate by reason of the fact that steam has higher thermal conductivity than air and the fact that the flow of steam which passes out of the chamber 4 substantially at the temperature of the base heats the sole-plate by convection. In a practical case, the temperature difference between the base and the sole-plate is then of the order of approximately 25° C., with the result that the high-temperature range in the case of the sole-plate is between 175° and 235° C.

Thus, so far as the sole-plate is concerned, the two temperature ranges (110° to 160° C. and 175° to 235° C.) are not juxtaposed. In practice, the user does not perceive this interruption in the temperature scale since his major concern is to change-over from a suitable temperature for ironing wool, for example, to a suitable temperature for ironing cotton. Furthermore, in contrast to synthetic fibers, textile fibers which permit ironing at temperatures above 150° C. do not necessarily require to be ironed at a strictly determined temperature but within a temperature range which is made even broader by the fact that smoothing is largely produced by injection of steam.

Particular emphasis is laid on the fact that the numerical temperature values are indicated solely by way of illustrative example. In fact, the temperature of an ironing sole-plate is not uniform and fluctuates to a considerable extent as a function of the point at which the measurement is made, of the instant at which said measurement is made with respect to the heat regulation cycle and also of the nature of the article to be ironed. In the numerical example which has been given, the temperatures indicated are mean values of temperatures measured at the center of the sole-plate, this point being considered by standards organizations as being representative of the behavior of laundry irons. The temperatures recorded are those corresponding to opening of the thermostat at an instant far in time from any change of adjustment of the reference value of the thermostat.

It is also worthy of note that, in accordance with conventional practice, thermostats make it possible to regulate the temperature of the heating base between room temperature and a maximum value such as 260° C. It is considered that a sufficient production of steam is impossible when the temperature of the base is lower than 150° C. Below this temperature, means are provided in some designs for preventing admission of water into the vaporization chamber.

Figure 4:
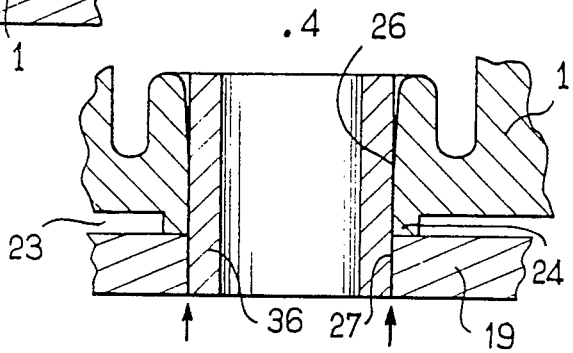
FIG. 4 is a view which is similar to FIG. 3 but relates to an alternative embodiment.

In the embodiment of FIG. 4, the orifices 27 of the sole-plate 19 no longer have lips 28, are cylindrical and have the same diameter as the corresponding orifices 26 of the base 1 which are also cylindrical. A sleeve 36 is forcibly fitted within each pair of corresponding orifices 26 and 27, the external face of said sleeve being welded to the wall of said orifices.

Figure 5:
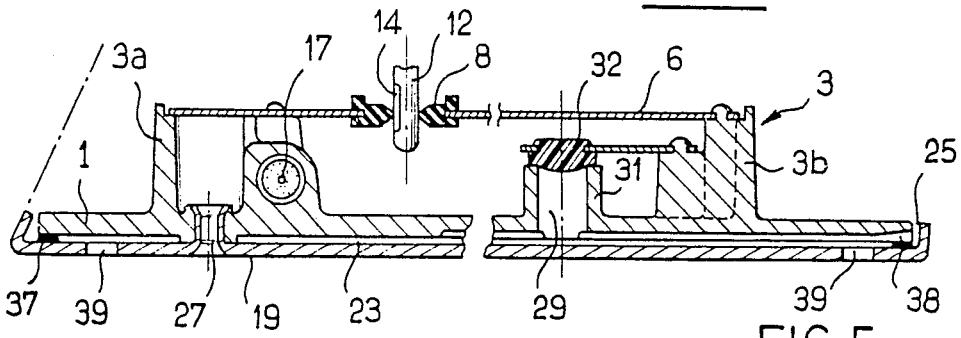
FIGS. 5 to 7 are three views which are similar to the bottom portion of FIG. 1 but relate to alternative embodiments.

In the example shown in FIG. 5, a seal 37 placed between the peripheral edge of the bottom face of the base 1 and the sole-plate 19 closes the intercalary space 23 except at the rear end of the iron at which the bottom face of the base 1 is hollowed-out at 38 so as to form a discharge outlet having a sufficient crosssectional area.

The advantage of this embodiment lies in the fact that it limits the escape of steam to the rear region of the iron for reasons of convenience of use.

In another alternative embodiment visualized in FIG. 5, the sole-plate 19 is provided around its entire periphery with holes 39 through which the space 23 communicates with the exterior so that the steam which has passed through the space 23 escapes through the fabric to be ironed. In this case, the seal 37 preferably extends over the entire periphery of the bottom face of the base 1 including the rear end of the iron in order to prevent any release of steam at the periphery of the base 1. This accordingly offers an advantage in that the production of steam which passes through the intercalary space 23 is put to effective use for the ironing operation. On the other hand, the rate of flow within the intercalary space is liable to be insufficient when ironing certain fabrics.

Figure 6:
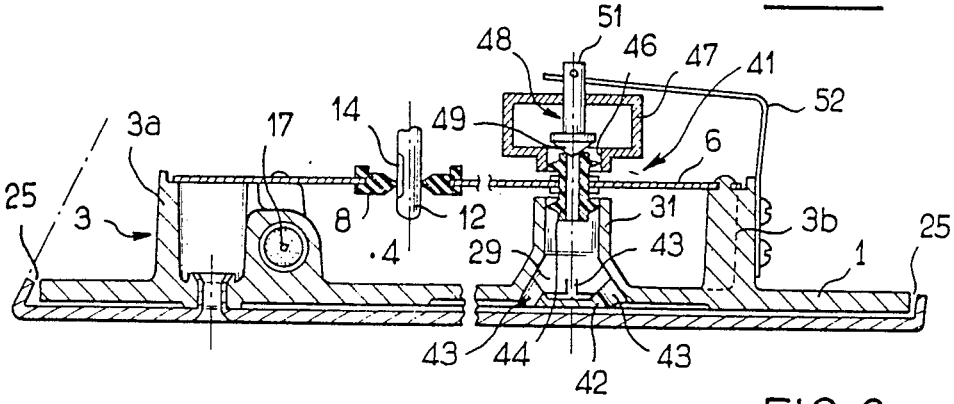

In the example illustrated in FIG. 6, the escape of steam originating from the space 23 takes place along the entire periphery of the base 1 as shown in FIG. 1. On the other hand, the steam which is intended for the space 23 is produced within an independent steam generator 41. This generator includes a cup 42 which partly closes the opening 29 and is integrally joined to the base 1 by means of bridges 43. A nozzle 44 of plastic material is mounted in leak-tight manner within an opening of the cover 6. Moreover, said nozzle is tightly fitted within the boss 31 beneath the cover 6 and tightly fitted within a bottom opening 46 of a water reservoir 47 placed above the cover 6. A valve 48 mounted within the reservoir 47 has a head 49 which is adapted to cooperate with a valve-seat formed by the top end of the nozzle 44. Said valve 48 also has a stem 51 which is mounted so as to be capable of displacement in sliding motion through the top wall of the reservoir 47 and which is attached to the movable end of a bimetallic strip 52. The other end of said strip is fixed in thermal contact with the external face of the portion 3*b* of the rib 3 which is integrally formed with the base 1.

In this embodiment, when the temperature of the base 1 oversteps the threshold of 200° C., for example, the snap-action bimetallic strip 52 lifts the valve 48 from the nozzle 44, with the result that the water contained in the reservoir 47 is permitted to flow drop by drop into the orifice 29, then impinges upon the cup 42 on which it evaporates within the space constituting the vaporization chamber and surrounded by the boss 31 before being finally discharged between the bridges 43 in the direction of the intercalary space 23.

This arrangement makes it possible to hold in reserve the entire steam production capacity of the chamber 4 to be delivered to the orifices 27 when ironing within the high-temperature range.

The example of FIGS. 7 and 8 will be described only in connection with the differences between this latter and the example of FIG. 5.

A tube 53 of flexible plastic material is tightly fitted on the one hand on the boss 31 which surrounds the opening 29 and on the other hand on a neck 54 formed around a bottom outlet of a reservoir 56 which is tightly fitted in position within an opening of the cover 6. A diaphragm or membrane 57 defines within the reservoir 56 a bottom chamber 58 filled with a fluid having a very low vapor pressure and good thermal conductivity such as, for example, a mineral or organic oil of the type employed as heat-transporting fluid in the solar energy industry in furnaces or solar energy collectors or else a fusible salt employed for tempering of metals. The membrane 57 is controlled by a rod 59 slidably mounted through an opening formed in a cover 61 which closes the reservoir 56 at the top and is provided with a vent 62 for connecting the reservoir 56 to the atmosphere above the membrane 57. The external end of the rod 59 is attached to the bimetallic strip 33.

Figure 7:
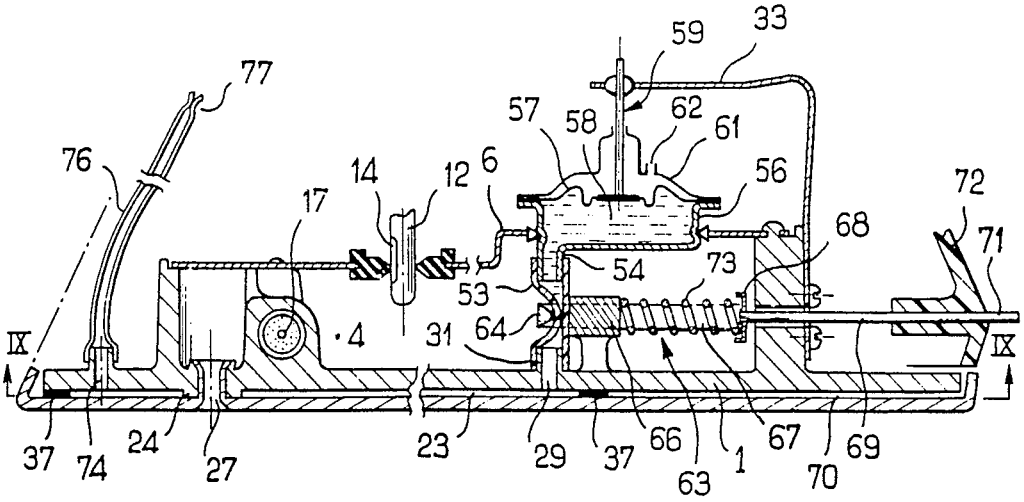
Figure 8:
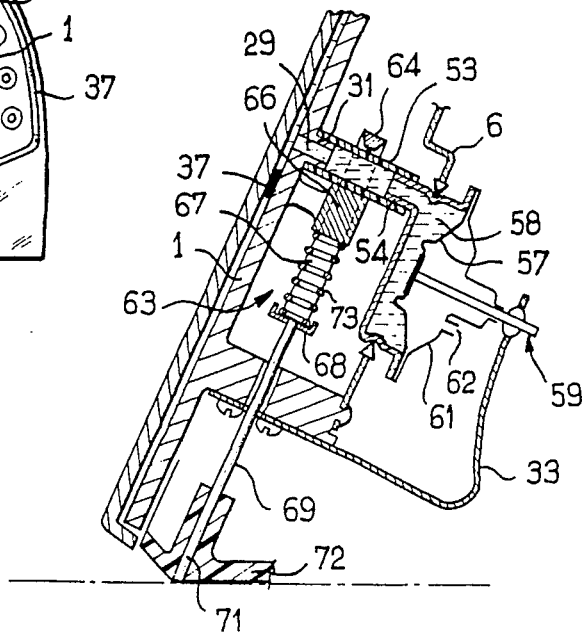
FIG. 8 is a view which is similar to the right-hand portion of FIG. 7 but shows the iron in the position in which it is resting on its support heel.

The flow of fluid through the flexible tube 53 is controlled by a shut-off device 63 having a stirrup-piece 64 designed for displacement between the closed position shown in FIG. 7 in which the central portion of said stirrup-piece is applied against the front side of the tube 53 and thus clamps this latter against a counter-bearing member 66 formed in one piece with the base 1 and adjacent to the rear side of the tube 53 and an open position (shown in FIG. 8) in which the central portion of the stirrup-piece 64 is moved away from the tube 53 towards the front end of the iron, thus enabling the tube to re-assume its substantially cylindrical shape and allowing a fluid to flow within said tube. In a manner which has not been illustrated in the drawings, the arms 67 of the stirrup-piece 64 are guided in sliding motion along the member 66 between the two positions aforesaid. At the end remote from the central portion of the stirrup-piece 64, the rearwardly directed arms 67 are attached to a cup 68 which is in turn attached to the front end of a rod 69, said rod being mounted for sliding motion in the longitudinal direction of the iron. The rear end 71 of said rod projects from the rear end of the iron when the stirrup-piece 64 is in the closed position shown in FIG. 7. On the contrary, as shown in FIG. 8, the open position of the stirrup-piece 64 corresponds to a position of withdrawal of said rear end portion or end-stud 71 of the rod 69 within the body casing 72 of the iron. A spring 73 guided between the arms 67 of the stirrup-piece is mounted in compression between the member 66 and the cup 68 with a view to urging the stirrup-piece 64 towards its closed position shown in FIG. 7.

Figure 9:
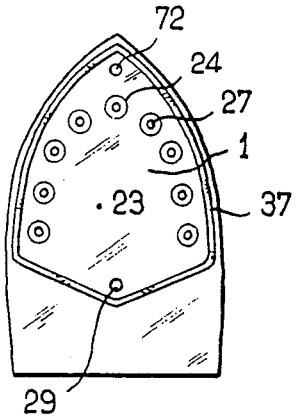
FIG. 9 is a view of the heating base, this view being taken along line IX—IX of FIG. 7.

As shown in FIG. 9, the seal 37 completely surrounds the intercalary space 23 but this space no longer extends to the rear end of the iron. In fact, the seal 37 passes behind the opening 29 so as to ensure that this latter is located at the bottom point of the space 23 when the iron is in a position of rest on its support heel as shown in FIG. 8. Furthermore, the neck 54 of the reservoir 56 is located in the foremost region of the bottom wall of the reservoir 56 so as to ensure that, in the rest position of FIG. 8, the opening 29 is located in an uppermost position with respect to the entire space constituted by the interior of the tube 53 and the chamber 58. An additional intercalary space 70 is therefore formed behind the seal 37.

At the front tip of the intercalary space 23, the base 1 is traversed by a gas-flow orifice 74 connected to a tube 76, the tube end 77 remote from the base 1 being hermetically closed.

The operation of the iron shown in FIGS. 7 to 9 takes place as follows: when the sole-plate of the iron is resting on a surface such as a piece of cloth to be ironed while the thermostat determines a base temperature within the low-temperature range (as in the case shown in FIG. 7), the spring 73 maintains the stirrup-piece 64 in the position in which the flexible tube 53 is pinched and isolates the chamber 58 from the intercalary space 23. The bimetallic strip 33 determines a high position of the rod 59 in which the volume of the chamber 58 is of maximum value. The intercalary space 23, the interior of the tube 76, the orifice 29 and the interior of the flexible tube 53 below the point at which this latter is pinched by the stirrup-piece 64 are filled with a gas such as air, for example, which limits heat transfers between the base 1 and the sole-plate 19. If the user operates the regulating knob of the thermostat so as to change-over to the high-temperature range, the bimetallic strip 33 exerts on the rod 59 an effort which tends to reduce the volume of the chamber 58. This effort is unavailing, however, and the situation remains unmodified as long as the user has not set the iron in the position shown in FIG. 8. At this moment, the end-stud 71 is thrust back and returns the stirrup-piece 64 to the open position, with the result that the fluid 58 can be driven back into the intercalary space 23 by the membrane 57 while the gas is in turn driven through the orifice 74 and then compressed within the tube 76. As soon as the iron is replaced in the position shown in FIG. 7, the end-stud 71 is released and the stirrup-piece 64 pinches the tube 53, thus stabilizing the situation. Within the intercalary space 23, the high-thermal-conductivity fluid produces a substantial reduction in temperature difference between the base 1 and the sole-plate 19.

If the thermostat control knob is again returned to a position corresponding to a low-temperature range, it is first necessary to set the iron in the rest position in order to ensure that the metallic strip 33 again causes the liquid to be sucked into the chamber 58 and allows the gas contained within the tube 76 to pass again into the intercalary space 23.

The design function of the shut-off system 63 is to prevent any gas from flowing upwards beneath the membrane 57 in the service position of the iron in which the liquid is in the high position with respect to the gas.

In an alternative embodiment, the means which are controlled by the bimetallic strip 33 in the examples described with reference to the accompanying drawings can be controlled instead by the position of the regulating knob of the thermostat such as the knob 18 of FIG. 1 or else by a specific manual control device.

In another alternative embodiment, the heating base can be provided with bearing bosses against which the sole-plate is applied but which are not traversed by steam-flow orifices in order to achieve complete control of heat transfer between base and sole-plate.

What is claimed is:

1. A steam iron including a heating base, a sole-plate mounted beneath said heating base so as to provide an intercalary space for containing a fluid between the heating base and the sole plate, ironing steam-generating means for generating steam by bringing a supply of water into contact with a top face of the heating base, means for regulating the steam ironing temperature, and heat conductivity control means for alternatively and selectively introducing into the intercalary space, during steam ironing, two different fluids having different heat conductivities.

2. A steam iron according to claim 1, wherein the fluid which occupies the intercalary space when ironing is in progress at a temperature within the low-temperature range is a gas and the fluid which occupies the intercalary space when ironing is in progress at a temperature within the high-temperature range is a liquid.

3. A steam iron according to claim 2, wherein the liquid is selected from a group consisting of mineral oils, organic oils, fusible salts.

4. A steam iron according to claim 2, wherein provision is made for a liquid having an adjustable volume so as to be enlarged at the time of ironing at low temperature, wherein said liquid chamber is in a low position with respect to the intercalary space when the iron is placed in the rest position on its support heel, and wherein means are provided for establishing a communication between the liquid chamber and the intercalary space when the iron occupies the rest position aforesaid and for interrupting said communication when the iron is in the ironing position.

5. A steam iron according to claim 1, wherein said fluid which occupies the intercalary space when ironing at a temperature within a low-temperature range is air and said fluid which occupies the intercalary space when ironing at a temperature within a high-temperature range is steam.

6. A steam iron according to claim 1, wherein the heat transfer control means are automatic means for introducing a said fluid having a relatively high heat conductivity during steam ironing at a high temperature range, and a said fluid having a relatively low heat conductivity during steam ironing and a low temperature range.

7. A steam iron according to claim 6, wherein the heat transfer control means are automatically controlled by temperature responsive means.

8. A steam iron according to claim 7, wherein the temperature responsive means are responsive to the temperature of the heating base.

9. A steam iron according to claim 7, wherein the temperature responsive means include a bimetallic strip.

10. A steam iron according to claim 1, wherein the heat-transfer control means include means for controlling a flow of one of said fluids within the intercalary space.

11. A steam iron according to claim 10, wherein the means for controlling a flow are of the binary type adapted to change relatively abruptly between a flow-interrupting end position and a flow-permitting end position.

12. A steam iron according to claim 1, wherein the intercalary space is connected on the one hand to a vaporization chamber via a movable closure member belonging to the heat tranasfer control means and on the other hand to discharge means.

13. A steam iron according to claim 12, wherein the vaporization chamber forms part of the ironing steam-generating means.

14. A steam iron according to claim 12, wherein the vaporization chamber forms part of additional steam-generating means.

15. A steam iron according to claim 1, wherein the discharge means include a slit between one edge face of the heating base and the edge face of the sole-plate.

16. A steam iron according to claim 1, wherein the discharge means include at least one orifice formed through the sole-plate.

17. A steam iron including a heating base, a sole-plate mounted beneath said heating base so as to provide an intercalary space for containing a fluid medium between the heating base and the sole-plate, ironing means steam-generating means for generating steam by bringing a supply of water into contact with a top face of the heating base, means for regulating the steam ironing temperature and heat conductivity control means for selectively controlling the heat conductivity of the fluid medium in the intercalary space during steam ironing.

18. A steam iron according to claim 17, wherein the heat conductivity control means are automatic means for setting said conductivity at a relatively high value during steam ironing at a high temperature range, and at a relatively low value during steam ironing at a low temperature range.

19. A steam iron according to claim 18, wherein the heat conductivity control means are controlled by temperature responsive means.

20. A steam iron according to claim 19, wherein the temperature responsive means are responsive to the temperature of the heating base.

21. A steam iron according to claim 19, wherein the temperature responsive means include a bimetallic strip.

22. A steam iron including a heating base, a sole-plate mounted beneath said heating base so as to provide an intercalary space containing a fluid between the heating base and the sole-plate, means for generating steam by bringing a supply of water into contact with a top face of the heating base, means for regulating the ironing temperature, and means for variably controlling the heat conductivity between the heating base and the sole-plate by modifying the fluid which is present within the intercalary space as a function of the ironing temperature so as to enhance heat transfer from the base to the sole-plate within a range of high ironing temperatures and to retard the aforesaid heat transfer within a range of low ironing temperatures, wherein the fluid which occupies the intercalary space when steam ironing is in progress at a temperature within the low-temperature range is a gas and the fluid which occupies the intercalary space when ironing is in progress at a temperature within the high-temperature range is a liquid.

23. A steam iron according to claim 22, wherein the liquid is selected from a group consisting of mineral oils, organic oils and fusible salts.

24. A steam iron according to claim 22, and a liquid chamber having an adjustable volume so as to be enlarged at a time of ironing at low temperature, wherein said chamber is in a low position with respect to the intercalary space when the iron is placed in the rest position on a support heel of said iron, and wherein means are provided for establishing communication between the chamber and the intercalary space when the iron occupies the rest position aforesaid and for interrupting said communication when the iron is in an ironing position.

25. A steam iron including a heating base, a sole-plate mounted beneath said heating base so as to provide an intercalary space containing a fluid between the heating base and the sole-plate, said intercalary space being connected on the one hand to a vaporization chamber via a movable closure member and on the other hand to discharge means, ironing-steam generating means for generating steam by bringing a supply of water into contact with a top face of the heating base, means during steam ironing for regulating the rate of flow of the fluid within the intercalary space by variably positioning the movable closure member as a function of the ironing temperature so as to enhance heat transfer from the base to the sole-plate within a range of high ironing temperatures and so as to retard the aforesaid heat transfer within a range of low ironing temperatures.

26. A steam iron according to claim 25, wherein the vaporization chamber forms part of the ironing steam-generating means.

27. A steam iron according to claim 25, wherein the vaporization chamber forms part of additional steam-generating means.

28. A steam iron according to claim 25, wherein the discharge means include a slit between one edge face of the heating base and the edge face of the sole-plate.

29. A steam iron according to claim 25, wherein the discharge means includes at least one orifice formed through the sole-plate.

30. A steam iron according to claim 25, wherein the means for regulating the rate of flow of the fluid within the intercalary space are controlled by temperature responsive means.

31. A steam iron according to claim 30, wherein the temperature-responsive means are responsive to the temperature of the heating base.

32. A steam iron according to claim 30, wherein the temperature responsive means include a bimetallic strip.

* * * * *